US008794032B2

(12) United States Patent
Goldstein

(10) Patent No.: US 8,794,032 B2
(45) Date of Patent: Aug. 5, 2014

(54) JEWELRY SET

(76) Inventor: Dana M. Goldstein, New York, NY (US)

( * ) Notice: Subject to any disclaimer, the term of this patent is extended or adjusted under 35 U.S.C. 154(b) by 0 days.

(21) Appl. No.: 13/353,366

(22) Filed: Jan. 19, 2012

(65) Prior Publication Data

US 2013/0186134 A1 Jul. 25, 2013

(51) Int. Cl.
*A44C 13/00* (2006.01)

(52) U.S. Cl.
USPC ..... 63/1.16; 63/12; 63/15.2

(58) Field of Classification Search
USPC ..... 63/15.1, 15.2, 1.11, 1.16, 1.17, 1.18
See application file for complete search history.

(56) References Cited

U.S. PATENT DOCUMENTS

| | | | | | |
|---|---|---|---|---|---|
| 271,121 | A | * | 1/1883 | Riley et al. | 63/12 |
| 498,648 | A | * | 5/1893 | Gumbart | 63/1.16 |
| 858,450 | A | * | 7/1907 | Greenbaum | 63/15.2 |
| 1,265,679 | A | * | 5/1918 | Krope | 63/15.2 |
| 1,681,687 | A | * | 8/1928 | Schraysshuen | 63/3 |
| 2,262,513 | A | * | 11/1941 | Novack | 63/15.2 |
| 2,281,231 | A | * | 4/1942 | Campana et al. | 63/15.2 |
| D178,743 | S | * | 9/1956 | Walley | D11/87 |
| 2,761,294 | A | * | 9/1956 | Lund | 63/15.2 |
| 2,766,599 | A | * | 10/1956 | Steffen | 63/15.6 |
| 4,291,551 | A | * | 9/1981 | Levine | 63/12 |
| 5,419,158 | A | * | 5/1995 | Sandberg et al. | 63/15.4 |
| 5,987,919 | A | * | 11/1999 | Hooser | 63/15 |
| 7,347,066 | B1 | * | 3/2008 | Feuer | 63/12 |

* cited by examiner

*Primary Examiner* — Victor Batson
*Assistant Examiner* — Abigail Morrell
(74) *Attorney, Agent, or Firm* — Ladas & Parry LLP

(57) ABSTRACT

A jewelry set includes a first jewelry item having a band for encircling a chosen part of a wearer's body and a second jewelry item having an attachment area and a decorative hoop, the hoop having a shape such that it can encircle the same chosen part of the wearer's body as the band. The first jewelry item has a connector for accepting and supporting the attachment area so that the hoop is maintained generally concentric with the band. The first jewelry item can be worn on the wearer's body either with both the band and the hoop encircling the chosen body part, or without the second jewelry item being attached, such that the second jewelry item can be worn separately from the first jewelry item. The first and second jewelry items may be, for example, a finger ring and a hoop earring.

6 Claims, 3 Drawing Sheets

JEWELRY SET

The present invention relates to a jewelry set able to be configured in different manners.

BACKGROUND OF THE INVENTION

A wide variety of jewelry items are available for human adornment. Finger and toe rings, earrings and wrist bangles, as well as other items, appear in a variety of shapes and designs. The typical piece of jewelry, however, is intended to be worn in a particular manner, and thus a wearer typically amasses an extensive collection of such items, each of which serves a single function and has a fixed appearance.

It is accordingly a purpose of the present invention to provide a coordinated set of jewelry items in which the items can be physically combined together such that the resulting item provides a unique appearance and thus provides a degree of flexibility to the items of the jewelry set.

Yet a further purpose of the present invention is to provide a coordinated set of jewelry items in which one or more of the items can be mounted to another of the items in a manner that allows the resulting jewelry item to be worn in a conventional manner, without permanently modifying any of the items such that the items can subsequently be separated and again worn individually.

BRIEF DESCRIPTION OF THE INVENTION

In accordance with the foregoing and other purposes and objects, the present invention comprises a coordinated set of first and second jewelry items, such as a finger ring and a pair of earrings. The first item has means to accept and support the second item in a manner that the first and second jewelry items functionally coordinate to allow the resulting item to continue to serve the intended purpose of the first item. The items can subsequently be disassembled to separately regain their original purpose.

BRIEF DESCRIPTION OF THE DRAWINGS

A fuller understanding of the invention will be achieved upon consideration of the following description of the invention when reviewed in conjunction with the annexed drawings, wherein.

DETAILED DESCRIPTION OF THE INVENTION

As depicted, the present invention provides for the removable joining of two separate jewelry items, such as a ring and a set of earrings, to form a third jewelry item. In particular, one of the jewelry items, typically a ring, is modified by the mounting of a second item, such as an earring, to present a different appearance, while maintaining its functionality as a ring.

Figure 1:
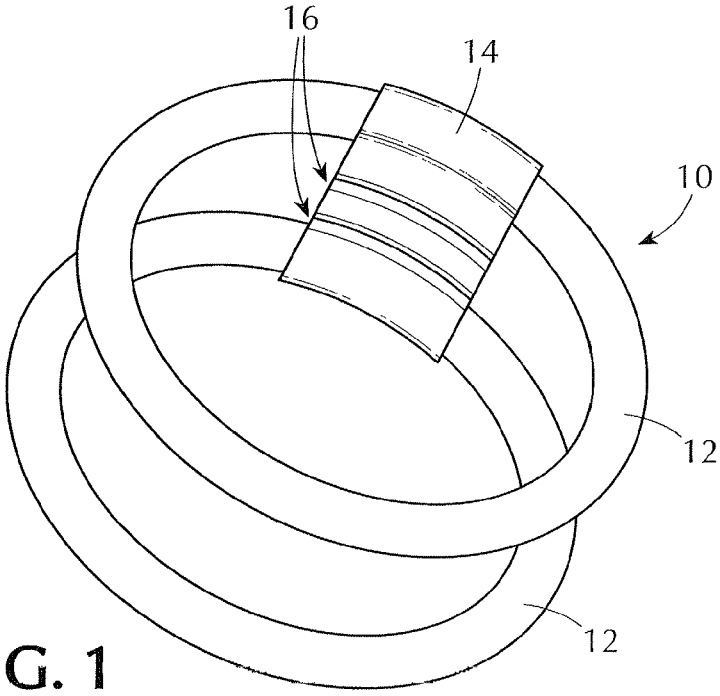
FIG. 1 is a perspective view of a first jewelry item in the form of a finger ring intended for use in the invention.
Figure 6:
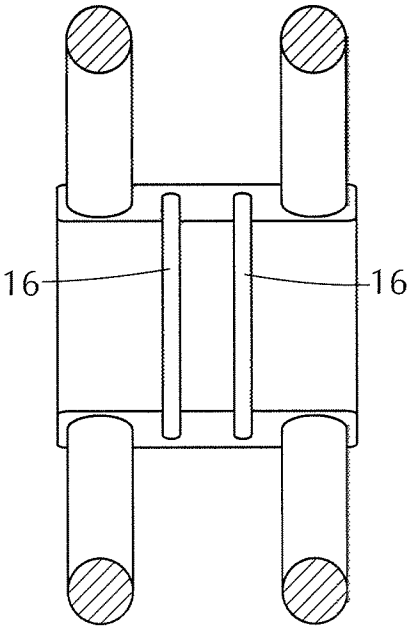
FIG. 6 is a sectional view taken along line 6-6 of FIG. 4, depicting the finger ring of FIG. 1 prior to mounting of the earrings thereupon.

As shown in FIG. 1, finger ring 10 for incorporation into the invention comprises a pair of finger-encircling bands 12, joined together by base 14. Base 14 supports the bands in a parallel, spaced-apart orientation. In conventional fashion the diameter of the bands is chosen to allow the ring to be placed upon and worn on a finger. A pair of parallel slots 16 is milled into the inwardly-directed face of the base. See also FIGS. 5 and 6. The slots provide means for allowing, the second jewelry item to be mated with and supported by the first jewelry item.

Figure 2:
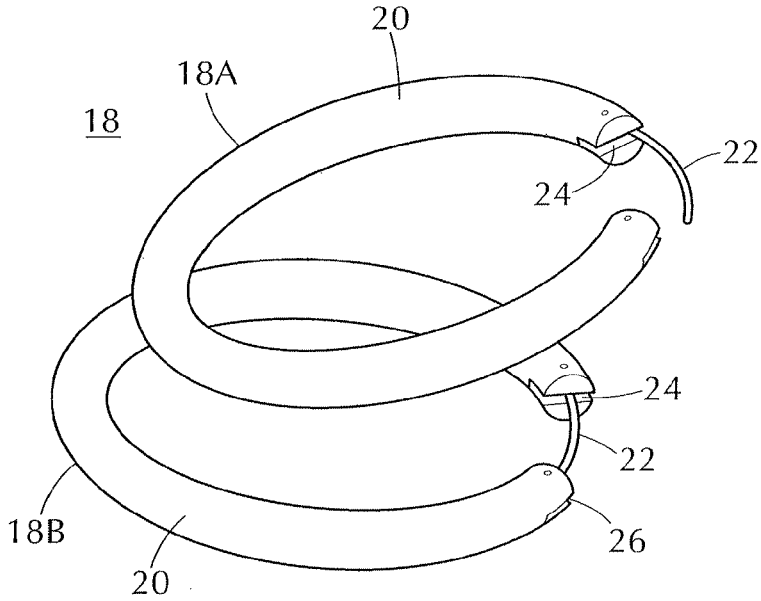
FIG. 2 is a perspective view of a second jewelry item in the form of a pair of earrings intended for use in the invention.

FIG. 2 depicts an earring pair 18 to be removably joined to the ring of FIG. 1. Each earring is of the hoop type, having a decorative hoop portion 20, the spaced apart ends of which are bridged by ear mounting post 22. One end of the mounting post is pivotally mounted within a slot 24 at a first end of the hoop portion 20, while the second end of the hoop portion 20 has a slot 26 to receive the frictionally receive the post. Earring 18A depicts the post in an open position, allowing the earring to be placed on the ear by passing the post through an ear piercing, while earring 18B depicts the post in the closed position, as when the earring is secured on the ear. Preferably, the diameter of the ring bands 12 and the earring hoops 20 are equal, such that the hoops 20, when aligned with the ring bands 12, allow a finger to be passed through all the aligned band and hoop apertures.

Figure 3:
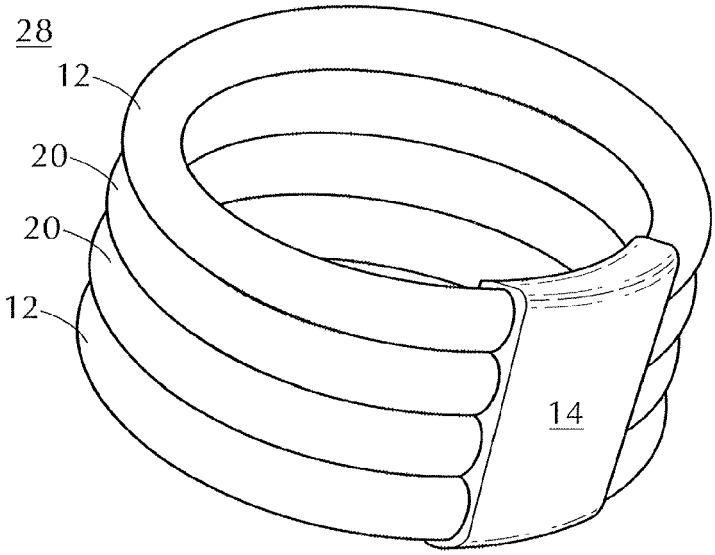
FIG. 3 is a perspective view of a jewelry item of the invention as formed from the combination of the first and second items as shown in FIGS. 1 and 2.
Figure 4:
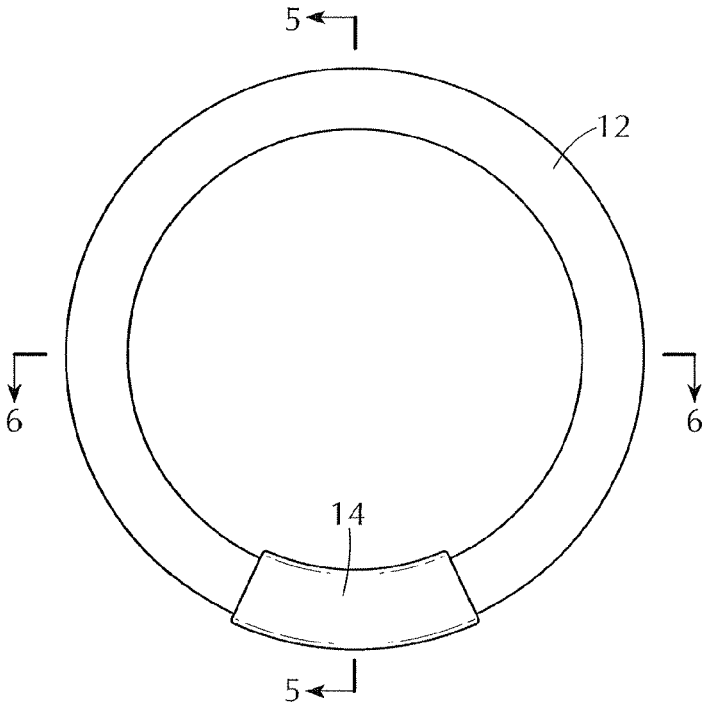
FIG. 4 is a plan view of a jewelry item having the general configuration of the item of FIG. 3.

As depicted in FIGS. 3 and 4, resulting ring construction 28 is composed of finger ring 10, comprising base 14 and bands 12, and earrings 18, also mounted to and supported by base 14. The ring bands 12 and earring hoops 20 are in parallel planes, with their apertures aligned, allowing the construction to be worn on a finger in the manner of a conventional ring. The earring mounting posts 22 serve at attachment areas for the earrings.

Figure 5:
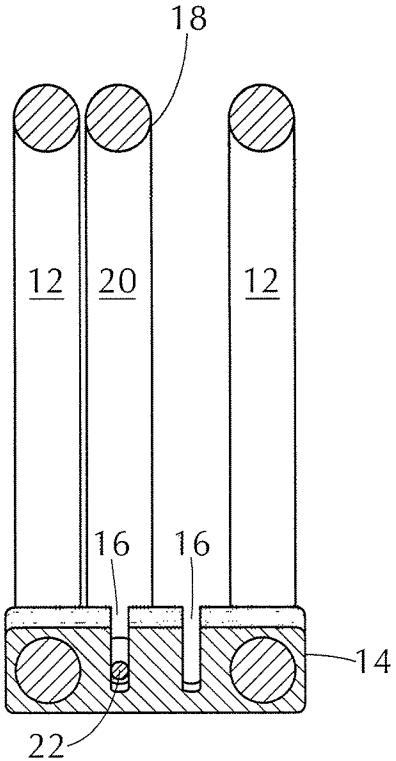
FIG. 5 is a sectional view along line 5-5 of FIG. 4, depicting a first earring of FIG. 2 installed upon the finger ring of FIG. 1.

With reference FIG. 5, it may be seen that an earring 18 (only one of which is shown) is supported by base 14 serving as a connector with the earring mounting post 22 attachment area (in the closed position) being captured within one of the parallel slots 16. The width of the slot is such that it forms a snug frictional fit with the mounting post. Such a snug fit, along with the curved shape of the mounting post, allows the earring to be maintained in an upright position, parallel to the ring bands 12. The bottom surfaces of the slots 16 are preferably gently arcuate along the slots' lengths to generally correspond to the curve of the mounting post and follow the lengthwise curvature of the base. The length of the ring base 14 may be chosen to span the entire distance between the ends of the ring hoops 12, such that the full exposed length of the earring posts 22 is captured by the base, the hoop ends abutting the ends of the base, providing a finished appearance to the resulting construction. Alternatively, the ends of the base may be provided with recesses to accept the ends of the hoop portions, providing additional support for the installed earrings. While the base in the Figures is depicted as being generally rectangular in plan, the invention contemplates that the base can be of any appropriate size and shape, allowing a wide variety of ring (or other first item) designs to be accommodated by the invention.

Figure 7:
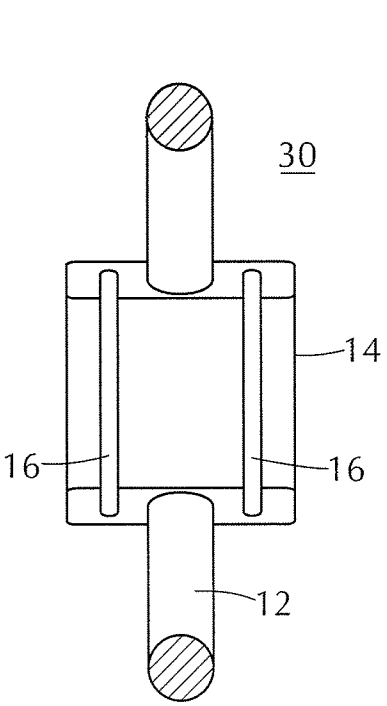
FIG. 7 is a sectional view taken along a line corresponding to 6-6 of FIG. 4, presenting an alternative embodiment of a ring intended for use in the invention.

Either one or both of a pair of earrings may be mounted to the ring base, allowing the appearance of the resulting ring construction to be varied. In addition, as shown in FIG. 7, finger ring 30 may have a single band 12, with a slot 16 positioned on each side of the single loop. Other formats are likewise contemplated, such as the provision of only a single slot, or locating the slot or slots in other positions and orientations with respect to the ring loop or loops, which can be mounted to the ring base in a variety of positions and manners. Multiple ring bands 12 can also be employed. Additionally, a plurality of earring sets may be configured for use with a given finger ring. For example, the wearer may have a pair of gold earrings and a pair of silver earrings, both of which are mountable to the same finger ring.

Further, the present invention is not limited to the combination of a finger ring as a first jewelry item and earrings as a second jewelry item. Other first items, such as toe rings or bangle bracelets can be used, while the second jewelry item may likewise be a pendant or the like, incorporating a hoop portion compatible with a band or loop on the first jewelry item and an attachment area or post portion adapted for engagement with a complementary support element on the first jewelry item to support the hoop(s) in register with the band(s) or loop(s) and allowing the resulting construction to continue to be worn as a (first) jewelry item. As with a finger ring/earring set, a plurality of second jewelry items can be configured to be mounted to the same first jewelry item. While it is preferable that the inner surfaces of the second jewelry item be smooth and round for best wearing comfort, it need not be so, and other item shapes, such as octagonal or oval, may also be used.

In addition, while the attachment areas in the form of earring posts 22 as depicted are of a diameter substantially smaller that the cross-section of the hoops 12, they need not have such a relationship, so long as the slots 16 are sized to accommodate the posts.

I claim:

1. A jewelry set, comprising:

a first jewelry item having a first band of a predetermined diameter for encircling a chosen part of a wearer's body; and a second jewelry item in the form of a first hoop earring having a first pivotable ear mounting post extending between ends of a first decorative hoop portion, the first hoop earring having a shape such that it can encircle the same chosen part of the wearer's body as the first band and being of substantially the same diameter as the first band, the first ear mounting post being of a smaller thickness than the immediately adjacent portions of the first decorative hoop portion;

the first jewelry item having a connector for accepting and supporting the first ear mounting post whereby the first hoop earring is maintained generally concentric with the first band such that the first jewelry item can be worn on the wearer's body with both the first band and the first hoop earring encircling the chosen part, the connector comprising a base with a first slot dimensioned for receipt and frictional retention of the first ear mounting post with the length of the base and the first slot extending substantially the length of the first ear mounting post whereby the immediately adjacent portions of the first decorative hoop portion closely abut ends of the base with the first ear mounting post inserted into the first slot, the first hoop earring being supported by the connector in a manner that substantially prevents any movement of the first hoop earring with respect to the first jewelry item.

2. The jewelry set of claim 1, wherein the first jewelry item is a finger or toe ring.

3. The jewelry set of claim 1, wherein the first jewelry item is a bangle.

4. The jewelry set of claim 1, wherein the first jewelry item further has a second band for encircling the chosen part of the wearer's body, the connector providing for concentric maintenance of the first hoop earring and the first and second bands.

5. The jewelry set of claim 4, wherein the connector base joins the first and second bands and maintains the first and second bands in a concentric relationship.

6. The jewelry set of claim 1, wherein the second jewelry item further comprises a second hoop earring having a second ear mounting post extending between ends of a second decorative hoop portion, the second hoop earring having a shape such that it can encircle the same chosen part of the wearer's body as the first band; the connector base having a second slot dimensioned for receipt and frictional retention of the second ear mounting post with the length of the second slot extending substantially the length of the second ear mounting post whereby immediately adjacent portion of the second decorative hoop portion closely abut ends of the base with the second ear mounting post inserted into the second slot, providing for concentric maintenance of the first and second hoop earrings with respect to the first band.

* * * * *